United States Patent [19]

Valaev et al.

[11] 3,954,380

[45] May 4, 1976

[54] METHOD AND APPARATUS FOR INTERMITTENT COMBUSTION

[76] Inventors: Alexandr Alexandrovich Valaev, 1 Novokuzminskaya ulitsa 20, korpus 2, kv. 75; Dmitry Georgievich Zhimerin, ulitsa Corkogo, 9, kv. 51; Eduard Alexandrovich Mironov, Kutuzovsky prospekt, 35/30, kv. 138; Vladimir Andreevich Popov, ulitsa Vavilova, 48, kv. 230, all of Moscow, U.S.S.R.

[22] Filed: Apr. 16, 1975

[21] Appl. No.: 568,788

Related U.S. Application Data

[63] Continuation of Ser. No. 506,507, Sept. 16, 1974, abandoned, which is a continuation of Ser. No. 408,432, Oct. 23, 1973, abandoned.

[52] U.S. Cl. ..... 431/1; 60/39.77

[51] Int. Cl.[2] ..... F23C 3/02

[58] Field of Search ..... 431/1, 2; 60/39.76, 60/39.77 X, 39.8, 248, 249

[56] References Cited

UNITED STATES PATENTS

| | | | |
|---|---|---|---|
| 2,911,957 | 11/1959 | Kumm | 431/1 X |
| 3,143,160 | 8/1964 | Rydberg | 60/39.77 X |
| 3,263,418 | 8/1966 | Lange et al. | 60/39.76 X |
| 3,449,913 | 6/1969 | Grebe | 60/39.76 X |

*Primary Examiner*—Edward G. Favors
*Attorney, Agent, or Firm*—Holman & Stern

[57] ABSTRACT

A pulse-action detonation combustion chamber enables the speed-, temperature- and pressure-modulated flow of the combustion products at a peak temperature of up to 4000°C, pressure up to 30 atm and speed up to 1000 m/s with a repetition frequency of impulses of up to 100 c/s. The combustion chamber comprises a combustion chamber proper is in the form of a tube closed at one end, manifolds are provided for the supply of fuel, oxidizer and a non-combustible material respectively, an ignition arrangement and means for cooling the fuel and oxidizer supply manifolds. The chamber can be filled with fuel in an amount sufficient to develop detonation due to the measures preventing the fuel from being prematurely ignited. Such premature ignition may take place because of the contact of the fresh fuel with the hot combustion products expelled by such fuel. The prevention of the premature ignition is achieved due to the formation of a zone of a cooled non-combustible material separating the fresh fuel from the combustion products of the preceding detonation combustion cycle.

8 Claims, 14 Drawing Figures

METHOD AND APPARATUS FOR INTERMITTENT COMBUSTION

This is a continuation of application Ser. No. 506,507 filed Sept. 16, 1974 which in turn is a continuation of Ser. No. 408,432 filed Oct. 23, 1973 both applications now abandoned.

BACKGROUND OF THE INVENTION

The present invention relates to methods of intermittent combustion of fuel and to detonation combustion chambers and may be used in plants performing the conversion of the chemical energy of fuel into electric power by means of MHD generators, in order to produce intermittent light emission, generate powerful sonic perturbations and organize the combustion process in prime movers.

The method of detonation combustion of fuel mixture is known. The detonation combustion differs from the deflagration combustion by elevated pressure, temperature and speed of the combustion products which, for the gas detonation, attain the values of 30 atm, 4000°K and 1000m/s respectively with a normal initial state of the fuel mixture.

High speeds of the detonation combustion of up to 3000–4000 m/s makes it difficult to enable a continuous detonation combustion of fuel in the combustion chambers since they require corresponding high rates of fuel supply. The cyclic detonation combustion, which is characterized by admissible rates of filling of the combustion chamber with fuel with subsequent positive ignition and practically instantaneous combustion of fuel, makes it possible to overcome this difficulty.

From the viewpoint of the thermal stress of the combustion chamber, as well as in the case of MHD generating production of light emission and in other technical applications of the chamber, the cyclic detonation combustion may be of practical interest at frequencies of up to scores and hundreds of c/s.

PRIOR ART

The known detonation cumbustion chamber (U.S. Pat. No. 3,263,418) comprises a chamber of a detonation wave generator and a combustion chamber. It is equipped with nozzles providing the supply of fuel and oxidizer located on the peripheral surfaces of the chamber of the generator and of the combustion chamber, as well as with an electric spark plug mounted at the closed end of the generator chamber.

The known detonation combustion chamber is intended for cyclic combustion of liquid and solid fuel and oxidizer under the detonation conditions ot produce a traction force. As is known, the use of the liquid fuel and oxidizer has some peculiar features associated with their incompressibility and high latent vaporization heat.

The gaseous fuels and oxidizers are the most widely used and the most technologically convenient ones. The cyclic detonation combustion of such fuels and oxidizers at the above-mentioned frequencies is difficult due to the premature inflammation of the fuel during the filling of the combustion chamber resulting from the contact with the hot combustion products remaining from the preceding detonation combustion cycle and expelled by that fuel.

By the known method of detonation combustion of gaseous fuel in the detonation tubes the hot combustion products are either cooled through the tube walls, or evacuated by means of vacuum pumps prior to the filling of the tube with fuel. Both methods require a long time to achieve the necessary result. Therefore, the detonation combustion can be performed only at intervals of secnds and even minutes.

OBJECTS AND SUMMARY OF THE INVENTION

It is an object of the invention to increase the repetition frequency of the cycles of detonation combustion fuel mixture.

Another object of the invention is to provide a pulse-action detonation combustion chamber which is capable of operating at a frequency of the order of 100 c/s.

Still another object of the invention is to improve the power capacity of the detonation combustion chamber.

The invention resides in the provision of a method of intermittent combustion of fuel mixture and of a pulse action detonation combustion chamber for carrying out this method.

Accordingly, there is herein contemplated a method of intermittent detonation combustion of a fuel mixture in a combustion chamber comprising the steps of providing admission manifolds feeding fuel oxidizer separately into the combustion chamber and igniting fuel intermittently, cooling the combustion products forced into the admission manifolds under the effect of pressure rising for a short time in the combustion chamber, and delivered into the combustion chamber.

In addition, in order to improve the formation of said zone, it is desirable to supply fuel and oxidizer into the combustion chamber under different pressures.

An inert gas is preferably supplied into the combustion chamber at regular intervals after every cycle of detonation combustion so as to form said zone.

To carry out the method of intermittent detonation combustion of the fuel mixture, there is herein contemplated a pulse action detonation combustion chamber comprising a combustion chamber defined by a tube closed at one end and open at the other end, manifolds for feeding fuel and oxidizer, into the combustion chamber, and an ignition device to intermittently ignite the combustible mixture, which is characterized according to the invention, in that the manifolds are provided with means for cooling the combustion products entering into the manifolds due to short-term rise of pressure in the combustion chamber during the detonation combustion of the combustible mixture.

In addition, it is desirable to proportionate the impulse-action detonation chamber so that its length is equal to at least 40–60 times the diameter thereof, while the manifolds providing the supply of fuel and oxidizer should be incorporated into the peripheral walls of the combustion chamber at a distance not greater than 1–2 times the diameter from its closed end and an angle of about 60° with respect to the longitudinal axis of the chamber, with the ignition arrangement being perferably accommodated in the combustion chamber at a distance of 3–5 times the chamber diameter from the closed end thereof.

The means for cooling the combustion products entering into the manifolds providing the supply of fuel and oxidizer preferably comprise a heat exchanger arranged on the outisde of each manifold at inlets thereof to the combustion chamber.

The length of the portions of said manifolds is approximately equal to the length of the combustion chamber.

The invention will be better understood from the following detailed description of the method of intermittent detonation combustion of fuel mixture in a combustion chamber according to the invention and an embodiment of an impulse-action detonation combustion chamber with reference to the accompanying drawings, in which:

DETAILED DESCRIPTION OF THE DRAWINGS

Figures 1, 2, 3, 4, 5, 6, 7, 8, 9, 10, 11, 12, 13:
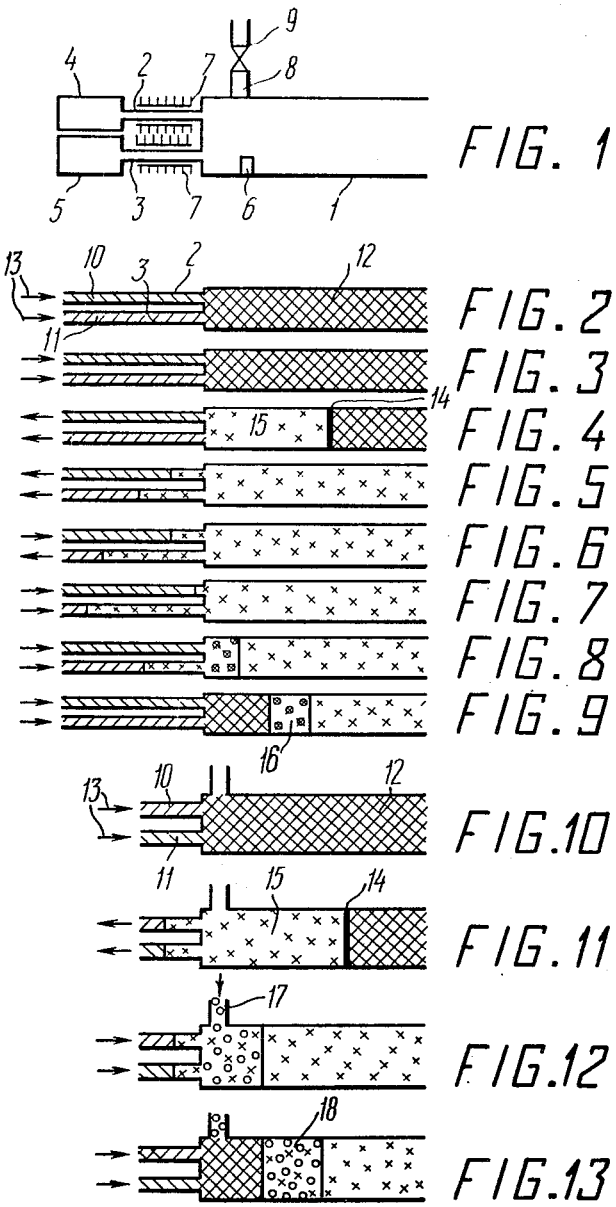
FIG. 1 is a diagrammatic view of an impulse-action detonation combustion chamber.
FIGS. 2, 3, 4, 5, 6, 7, 8, 9, show a sequence of steps of the intermittent detonation combustion of fuel mixture in the combustion chamber.
FIGS. 10, 11, 12, 13 show a sequence of steps of the intermittent detonation combustion of fuel misture in the combustion chamber in the case of the intermittent introduction of an inert material, such as nitrogen.

FIG. 1 shows a principle diagram of a pulse-action detonation combustion chamber. The pulse-action detonation combustion chamber comprises a combustion chamber proper 1, a manifold 2 providing the supply of oxidizer and a manifold 3 providing the supply of fuel, fuel and oxidizer sources 4, 5 for the combustion chamber, initiating means 6, means 7 for cooling the fuel and oxidizer manifolds and a manifold 8 having control means 9 for feeding an inert gas.

Constant and different pressure is maintained in the fuel and oxidizer sources 4 and 5 for the combustion chamber. Let it be assumed that the oxidizer pressure is higher than that of the fuel. An oxidizer 10 and fuel 11 are fed into the combustion chamber 1, in which they are mixed, to form a fuel mixture 12 (FIG. 2). Arrows 13 in FIGS. 2–9 indicate the direction of flow of the fuel 11 and the oxidizer 10. FIG. 3 shows the initiation of a detonation wave. Further, (FIG. 4) the fuel mixture 12 is burned behind the detonation wave 14. The pressure of combustion products 15 is substantially higher than the initial pressure in the combustion chamber and in the admission manifolds. Arrows in FIG. 5 indicate the outflow of the combustion products from the chamber, as well as the expulsion of the combustion products into the admission manifolds/due to a pressure increase in the combustion chamber. The combustion products 15 expelled into the manifolds are cooled by the cooling means 7. It should be noted, that the speed and depth of penetration into the manifold 2, which is under higher pressure, are lower. As the pressure in the combustion chamber diminishes due to the outflow of the combustion, products, the direction of flow in the manifold 2, which is under a higher pressure, is reversed (FIG. 6). Further reduction of pressure results in the change of the direction of flow in the manifold which is under a lower pressure, that is in the manifold 3 with the fuel 11 (FIG. 7). The combustion products 15 cooled in the manifolds 2, 3 flow into the combustion chamber to form a zone 16 (FIG. 8).

As shown in FIG. 8, the oxidizer 10 begins to flow into the combustion chamber. The oxidizer is mixed with the cooled combustion products flowing from the full manifold to additionally cool them. As shown in FIG. 9, both components of the fuel mixture are fed into the combustion chamber to form the fuel mixture 12.

The fuel mixture 12 is now separated from the hot combustion products 15 remaining from the preceding combustion cycle, by the zone 16 consisting of the combustion products cooled to the temperature below the ignition temperature of the fuel mixture. The presence of this zone prevents the fuel mixture fed into the combustion chamber from being prematurely ignited, which, in turn, allows for an acceleration of the filling of the combustion chamber with fuel and makes it possible to increase the filling and combustion frequency up to 100 c/s.

According to one of the embodiments of the method, the zone separating the combustion products of the preceding cycle from fresh batches of the fuel mixture is formed by positively feeding some inert gas, such as nitrogen into the combustion chamber.

In this case, nitrogen is fed into the combustion chamber through the manifold 8 in the zone adjacent to the oxidizer and fuel manifolds 2, 3 after every detonation combustion cycle.

The amount of nitrogen injected into the combustion chamber during the interval between the detonation combustion cycles should be sufficient to form the zone of a thickness which ensures the integrity of the zone during its displacement along the combustion chamber, with the zone thickness being of 3–4 times the diameter of the combustion chamber.

The steps of the method hereinabove described will be apparent from FIGS. 10, 11, 12, 13.

The oxidizer 10 and the fuel 11 are fed through the manifolds 2, 3 into the combustion chamber 1 to form the fuel mixture 13.

A detonation wave is shaped in the fuel mixture. The detonation wave 14 (FIG. 11) propagates in the fuel mixture 12. High pressure of the combustion products results in their expulsion into the fuel and oxidizer manifolds in which they are cooled by means of heat exchangers. FIG. 12 shows the step of the outflow of the combustion products from the combustion chamber.

Due to the pressure reduction, the combustion products cooled in the manifolds begin to flow into the combustion chamber. At the same time, an inert material 17, such as nitrogen is positively fed into the combustion chamber to be mixed with the combustion products so as to additionally cool them. The cooled combustion products 15 remaining from the preceding combustion cycle and nitrogen form a zone 18 separating the hot combustion products 15 of the preceding cycle from fresh batches of the fuel and oxidizer.

It will be apparent that the zones separating the hot combustion products from fresh batches of the fuel and oxidizer can be formed either by cooling the combustion products in the manifolds, or by using the effect of creating a different pressure in the supply sources of the combustion chamber, or by using an intermittent positive supply of a non-combustible material. Various combinations of these methods may be also used.

Figure 14:
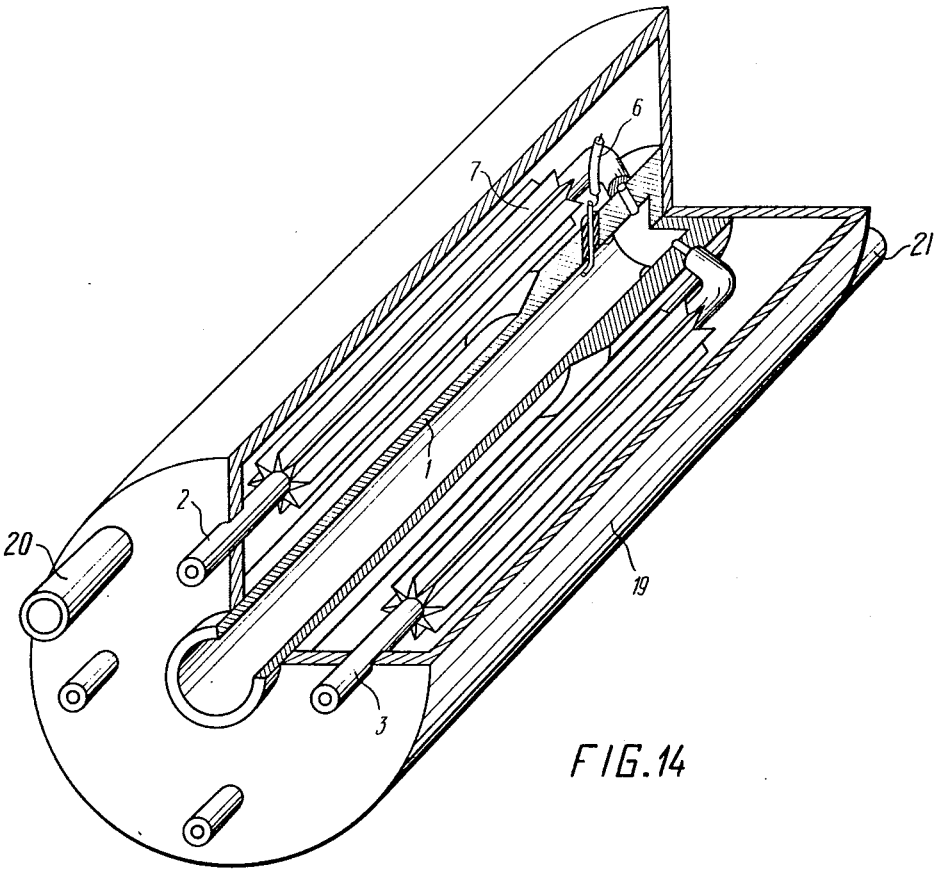
FIG. 14 is a perspective view partly cut away of an impulse-action detonation combustion chamber according to the invention.

Referring now to the pulse action detonation combustion chamber shown in FIG. 14, it comprises the combustion chamber proper 1 in the form of a metallic tube having a length of at least 40 to 60 times the diameter thereof, and which is open at one end. Connected to the closed end of the tube are the manifolds 2, 3 providing the supply of oxidizer and fuel, and a manifold 8 for feeding an inert gas. The manifolds are made of a material of high heat conductance, such as copper. The portions of the manifolds adjacent to the combustion chamber are provided with cooling means 7 to improve the cooling, with said means comprising heat exchangers. An electric spark plug 6 for the ignition of the fuel mixture is accommodated in the combustion chamber adjacent the closed end thereof. The combustion chamber 1 and the portions of the manifolds 2, 3 adjacent thereto are enclosed in a tightly sealed casing 19. In order to improve the cooling of the manifolds and the combustion chamber, the casing is filled with water which circulates through the inlet and outlet pipes 20, 21.

Upon igniting the fuel mixture contained in the tube, the combustion will gain the detonation conditions but after the combustion front has passed the acceleration zone. The length of this zone depends upon the composition of the mixture, roughness of the tube walls, power capacity of the ignition source and the distance between the ignition source and the tube end.

The creation of the detonation wave is accompanied by the formation of a detonation wave which is the compression wave propogating in the combustion products in the direction opposite to that of the detonation wave and entrains therewith the combustion products.

In this case, the flow of the combustion products following the detonation wave is used to expel the combustion products into the admission manifolds 2, 3 of the chamber 1, in which these products are cooled by means of the heat exchangers 7 to a temperature below the ignition temperature of the fuel mixture.

The efficiency of cooling, apart from the capacity of the heat exchangers 7, depends upon the penetration depth and the diameter of the manifolds 2, 3.

The penetration depth depends upon the total pressure in the manifolds 2, 3 and the ratio between the length of the zone of the combustion chamber 1 corresponding to the combustion front displacement under the detonation conditions and the length of the acceleration zone. In order to increase the penetration depth and the residence time of the combustion products in the manifolds, this ratio should be increased, while the total pressure in the manifolds should be reduced.

The length of the acceleration zone during the ignition of the gaseous fuel in rough tubes adjacent the closed end thereof for the most widely employed fuel mixtures (methane-oxygen, propane-oxygen, hydrogen-oxygen) is equal to 8–10 times the diameter of the tube. The presence of the openings required to connect the manifolds 2, 3 to the closed end of the chamber in the form of a tube, makes to increase this distance up to 20–30 times the diameter of the tube, with the cross-sectional area of the manifolds being equal to the cross-sectional area of the chamber 1. Accordingly, in order to ensure an appropriate ratio between the lengths of the detonation and acceleration zones, the combustion chamber should have a length of at least 20–60 times the diameter thereof.

In order to reduce the influence of the openings on the lengths of the acceleration zone, the inlets of the manifolds 2, 3 should be located in the peripheral walls of the chamber 1. An excessive reduction of the total cross-sectional area of the manifolds 2, 3 at a given fuel supply rate will result in an increased total pressure in the manifolds. To ensure the entry of the combustion products into the manifolds, this pressure should be lower than that behind the detonation wave (the pressure behind the detonation wave is by about 10 times higher than the initial pressure of the fresh mixture in the combustion chamber). If the components of the fuel mixture are fed under a pressure near to the atmospheric pressure at the ratio between the lengths of the detonation and acceleration zones of 2–3, the penetration depth is about equal to the length of the combustion chamber. Thus, the maximum possible length of the cooled portions of the fuel and oxidizer admission conduits of the combustion chamber should be about equal to the length of the combustion chamber.

Since the fuel mixture components are mixed directly inside the chamber, the intermittent-action ignition source should be preferably accommodated at the point, at which the components are sufficiently mixed. On the other hand, in order to make the acceleration zone shorter, the ignition source should be placed directly adjacent to the closed end of the chamber. An optimum distance of the ignition source from the closed end of the chamber is of 3–5 times the diameter thereof.

In order to eliminate the formation of the dead zone adjacent the closed end of the chamber, the manifolds providing the supply of the fuel components should be connected at a distance of less than 1–2 times the diameter from the closed end of the chamber so as to direct the gas stream from the manifolds to the rear wall of the chamber.

The impulse-action detonation combustion chamber makes it possible to produce speed-, temperature- and pressure-modulated streams of the combustion products of the gaseous fuels at elevated peak values of these parameters and at frequencies of the practical importance. The fuel may comprise methane, natural gas, hydrogen and the like. The oxidizer may comprise oxygen and air. For combustion of natural gas and methane, oxygen or air enriched with oxygen may be used. The intermittent conditions of the operation of the combustion chamber ensure low average temperature and pressure in the combustion chamber. Low average temperature and pressure of the combustion products result in low temperature of the chamber walls which is especially advantageous at a high peak temperature and speed of the combustion products in the MHD electric power generators.

Low average pressure in the combustion chamber, which can be only slightly higher than atmospheric pressure, permits to dispense with the high-pressure compressors for feeding fuel components into the combustion chamber. The repetition frequency of the impulse streams of the combustion products can be readily controlled by adjusting the repetition frequency of the electric ignition pulses.

What is claimed is:

1. A method of intermittent detonation combustion of a fuel mixture in a combustion chamber comprising the steps of providing admission manifolds feeding a fuel and an oxidizer separately into the combustion chamber igniting fuel intermittently, cooling the combustion products forced into the admission manifolds under the effect of pressure rising for a short time in the combustion chamber and delivered into the combustion chamber.

2. The method of intermittent detonation combustion as claimed in claim 1, wherein fuel and oxidizer are fed into the combustion chamber under different pressure.

3. The method of intermittent detonation combustion as claimed in claim 1 comprising feeding an inert gas into the combustion chamber after every next detonation combustion cycle.

4. A pulse-action detonation combustion chamber for carrying out an intermittent detonation combustion of a fuel mixture comprising a combustion chamber defined by a tube having opposite ends, said tube being closed at one end and open at the other end; manifolds for feeding fuel and oxidizer into the combustion chamber an ignition device to intermittently ignite the combustible mixture; and said manifolds being provided with means for cooling the combustion products entering the manifolds due to a short-term use of pressure in the combustion chamber during the detonation combustion of the combustible mixture.

5. The pulse-action detonation combustion chamber according to claim 4, wherein the manifolds are incorporated in the side walls of the combustion chamber at a distance not more than 1–2 diameters of the combustion chamber from the closed end thereof at an angle of about 60° to the longitudinal axis of the combustion chamber.

6. The pulse-action detonation combustion chamber according to claim 4, wherein said ignition device is installed in the combustion chamber at a distance of 3–5 diameters of the combustion chamber from the closed end thereof.

7. The pulse-action detonation combustion chamber according to claim 4, wherein said means for cooling the combustion products entering the manifolds are defined by a heat exchanger arranged on the outside of each manifold at inlets thereof to the combustion chamber.

8. The pulse-action detonation combustion chamber according to claim 7, wherein the length of the portions of the fuel and oxidizer feeding manifolds is about equal to the length of the combustion chamber.

* * * * *